United States Patent [19]

Adamski, Jr. et al.

[11] 4,127,075

[45] Nov. 28, 1978

[54] SUCTION DEVICE FOR SEWING MACHINES

[75] Inventors: Maximilian Adamski, Jr., Wheeling; John A. Kuhn, Rolling Meadows, both of Ill.

[73] Assignee: Union Special Corporation, Chicago, Ill.

[21] Appl. No.: 827,526

[22] Filed: Aug. 25, 1977

[51] Int. Cl.[2] ..... D05B 37/04

[52] U.S. Cl. ..... 112/122; 112/153; 112/287; 112/DIG. 1

[58] Field of Search ..... 112/122, 287, 123, 129, 112/130, 141, 153, DIG. 1

[56] References Cited

U.S. PATENT DOCUMENTS

| | | | |
|---|---|---|---|
| 2,827,867 | 3/1958 | Happe | 112/DIG. 1 |
| 2,989,935 | 6/1961 | Butler | 112/DIG. 1 |
| 3,050,970 | 8/1962 | Billi | 112/DIG. 1 |
| 3,434,438 | 3/1969 | Forrest et al. | 112/122 X |
| 3,490,403 | 1/1970 | Boucraut | 112/287 |
| 3,543,706 | 12/1970 | Reid et al. | 112/141 X |
| 3,543,708 | 12/1970 | Armstead, Jr. | 112/287 |
| 3,602,172 | 8/1971 | Bray | 112/DIG. 1 |
| 3,631,826 | 1/1972 | Morgan | 112/141 |
| 3,749,040 | 7/1973 | Jurgens | 112/287 |

FOREIGN PATENT DOCUMENTS

| | | | |
|---|---|---|---|
| 1,177,276 | 9/1964 | Fed. Rep. of Germany | 112/DIG. 1 |

*Primary Examiner*—Werner H. Schroeder
*Assistant Examiner*—Moshe I. Cohen
*Attorney, Agent, or Firm*—John W. Harbst; John A. Schaerli

[57] ABSTRACT

The present invention relates to an apparatus which removes from the stitching area of a sewing machine a continuous strip of material which has been severed from the marginal edge of a workpiece being sewn. The apparatus includes a tubular member having an inlet end positioned above the work support and in front of the material severing mechanism of the machine. The other end of the tube is connected to a source of reduced pressure whereby creating a suction at the inlet end of the tubular member for drawing the continuous severed strip away from the material trimming mechanism and the stitching area.

4 Claims, 5 Drawing Figures

SUCTION DEVICE FOR SEWING MACHINES

CROSS REFERENCES

This invention is an improvement over the apparatus as shown in U.S. Pat. No. 3,786,768 issued Jan. 22, 1974 to R. L. Kosrow et al.

BACKGROUND OF THE INVENTION

This invention relates to a sewing machine and in particular to a suction device associated therewith.

The type of sewing apparatus shown in the above identified patent is employed for the hemming of garments. Employed in combination with an apparatus of this sort is a machine which is commonly referred to as an overedge sewing machine. An inherent feature of overedge sewing machines, is that there is provided thereon a trimming mechanism which severs the marginal edge of a workpiece whereby forming a continuous residual strip which requires removal from the sewing area so as to not interfere with the subsequent stitching operation. As is also shown in the above identified patent, there is employed an edge guide mechanism which effectively guides one edge of the material workpiece into proper position relative the needle of the machine. It should be pointed out that in a hemming apparatus of type shown in said patent, guidance of the workpiece takes on special importance in that there is no manual dexterity employed once the hemming apparatus has begun its cycle.

It is well shown in the art of sewing machines in general, to position a suction tube on the underside of the workpiece support for drawing refuse from the stitching and trimming area. However, if a suction tube would be used, as suggested in the art, in combination with a mechanism of the type described in said patent the diameter of the suction tube could be limited to the dimensional area available on the underside of the work support plate. In view of the various mechanisms and apparatus which is situated about the workpiece support of the above identified patent, the dimensional area available on the underside of the support plate would require that the suction tube be limited to such an extent that the inlet opening of the tube could easily become jammed by the continual strip of material severed by the trimming mechanism.

In addition to this, most of the suction devices shown in the art have been employed to remove particles of debris, that is, thread chain cuttings, etc., and are usually situated rearward of the stitch forming instrumentalities. Most of the heretofore known suction devices have not been utilized for removing a continuous residual strip of material from the area of the trimming mechanism and therefore the size of the suction tube diameter has not been an important factor. As is apparent, if a small diameter suction tube were utilized on the underside of the work surface in combination with a hemming apparatus as described in said patent other disadvantages occur. A smaller diameter tube results in a reduced vacuum area and therefore requires a higher degree of suction force for broadening the region of suction so as to be capable of drawing the continuous residual strip into the tube. However, this increase in vacuum may effect the guidance of the workpiece itself, which, as mentioned above, is of great importance in the operation of a hemming apparatus of this sort. That is, the guidance of the workpiece could be effected by the suction force drawing the severed marginal edge downward. Accordingly, that portion of the garment still fastened to the residual strip is drawn against a rearwardly extending finger which forms part of the guidance mechanism whereby creating frictional forces. The availability for placement of the suction tube on the underside of the work support dictates that the continuous residual strip travel in a path leading from the workpiece which is on one side of the trimming mechanism to the open end of the suction tube which is positioned on the opposite side of the trimming mechanism. In this manner the continuous residual strip could be drawn downward and against the sharp edge portion of the lower knife of the trimming mechanism whereby creating further frictional forces. The combination of the frictional forces, inherent with the finger and the lower knife, although slight, could result in the displacement of the remainder the workpiece relative the edge guide mechanism. This displacement is possible in view of the fact that there is no manual dexterity and therefore no correctional factors employed in guiding the workpiece to the stitching mechanism. In a bottom hemming apparatus of the type described in said patent the guiding of the workpiece is mechanically manipulated at the onset of the cycle and the sewing machine is automatically operated thereafter. In view of the frictional forces operating on the workpiece during the sewing cycle it is possible that the workpiece would become misguided relative the edge guiding mechanism whereby resulting in the production of an unacceptable garment. For the reasons discussed hereinabove, the art heretofore known does not readily lend itself in combination with an apparatus as described in the above identified patent.

SUMMARY OF THE INVENTION

In view of the foregoing, and in accordance with the present invention there is provided a suction device for sewing machines which eliminates the problems heretofore known and which serves the purpose of effectively removing from the working area of the machine a continuous residual strip of material which has been severed from the marginal edge of the workpiece being sewn.

The problem of overcoming all of the heretofore mentioned constraints essentially is solved by providing a suction device which is positioned above the work support and in front of the trimming mechanism proximate the sewing area. That is, the present invention contends with the space available on the underside of the work surface by positioning the suction tube on top of the work support surface thereby lessening the constraints with regards to the diameter of the suction tube. By not limiting the diameter of the suction tube it is possible to provide an inlet opening which is large enough to avoid becoming jammed by the continuous residual strip which is being severed from the marginal edge of the workpiece. In addition, the larger diameter suction tube allows less of a suction force to be produced at the inlet opening while at the same time allowing a broad area coverage for drawing the continuous strip away from the trimming mechanism. By positioning the suction tube above the top surface of the work support the drawing action of the suction tube is effective to reduce the frictional forces inherent about the guide mechanism of the machine. The upwardly directed force draws the residual strip above the lower knife of the trimming mechanism whereby avoiding any contact therewith. The positioning of the present invention also aids in guidance of the workpiece by lifting that portion of the workpiece over the rearwardly extending finger whereby greatly reducing the frictional forces inherent in this area and, in general, in the area of the edge guiding mechanism. As is apparent, the reduction in frictional forces aids in the guidance of the fabric workpiece to the stitching mechanism of the machine. With the design and arrangement of the type herein described, it is possible to position a suction device above the top side of the work support in front of the edge trimming mechanism whereby effectively removing the continuous strip of severed material from the working area of the machine so as not to interfere with the machines proper function as the workpiece is being sewn.

Therefore a primary object of this invention is the provision of a suction device which is adapted to carry away a continuous residual severed length of material whereby the working area of the machine is maintained clean and free of residual matter.

It is another object of this invention to provide a suction device which relieves the frictional forces inherent about the area of the guiding mechanism.

It is a further object of this invention to provide a suction device which is supported above the work support of the sewing machine and spaced forwardly of the stitch forming area in a manner to enhance the guiding characteristics of the machine.

It is still a further object of this invention to provide a suction device which is in a position to draw a continual strip of severed material upwardly above the workpiece and in a direction opposite to that in which the workpiece is being fed.

Another object of this invention is the provision of a suction device which is simple and inexpensive, positive and automatic in operation, and has no moving parts, whereby it requires no maintenance.

Further objects and advantages of this invention will become apparent from the description now to follow of the preferred embodiment thereof shown by way of example in the accompanying drawings, in which.

DETAILED DESCRIPTION OF THE PREFERRED EMBODIMENT

Figure 1:
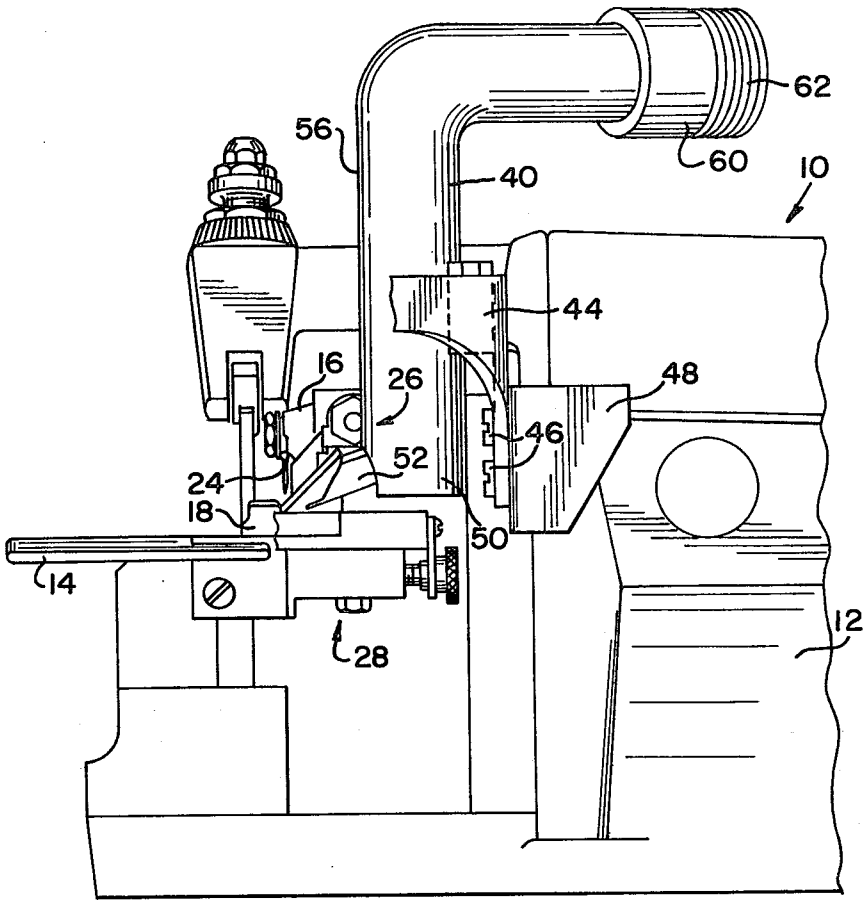
FIG. 1 is a partial front elevational view of the machine incorporating the present invention.

For the purpose of discussion, but without limitation, the invention will be described herein with reference to an automatic hemming apparatus such as that shown in the above identified patent. However, it should be appreciated that the present invention may be equally applied to other types of machines as well. Referring now in more detail to the drawings, wherein like reference numerals indicate like parts throughout the several views, the present invention is shown as being positioned on a conventional sewing machine which is generally identified by the numeral 10. For descriptive purposes, the machine shown herein may be considered of the type disclosed in the U.S. Pat. No. 2,704,042 granted Mar. 15, 1955 to N. Wallenberg et al. The sewing machine 10 includes a frame means 12 which has mounted thereon in the customary manner a cloth plate means 14, a needle arm means 16 and a presser foot means 18. The presser foot means 18 is resiliently urged downwardly toward the work support or throat plate means 20 (FIG. 5) to cooperate with conventional feed dog means 22 to feed work material 70 (FIG. 5) through the machine sewing station indicated by needle means 24. The machine means 10 is further provided with a conventional trimming mechanism indicated generally as at 26 for severing the marginal edge of the material workpiece as it is fed through the machine. The trimming mechanism includes a pair of blade means 74 and 75 which are adapted for movement into a cutting relationship whereby severing the marginal edge of the workpiece.

Mounted on the frame means 12 in association with the cloth plate means 14 is an adjustable edge guide mechanism assembly means 28 which is effective to guide the workpiece to the sewing station of the machine. It should be noted from FIG. 3 that the edge guide mechanism means 28 is formed with a rearwardly extending finger means 29 which effectively guides the lower portion of an S-shaped hem fold to the proximate area of the sewing station 24 of the machine. The upper portion of the S-shaped fold rides over the finger means 29 and is severed by the knife mechanism means 26. For a more detailed description of this assembly, reference should be made to the above identified U.S. Pat. No. 3,786,768. As mentioned above, once the sewing cycle has begun, no manual dexterity is employed to position the material relative the edge guide mechanism means 28. That is, upon initiation of the sewing cycle the machine operation is automatic and the guidance of the workpiece is dependent upon operation of the machine.

As has been indicated, the present invention is of particular utility in connection with machines intended to sever a marginal edge of a workpiece as the latter is fed through the machine. As each workpiece is advanced through the stitch forming zone of the sewing machine, the edge trimming mechanism means 26 severs the marginal edge of the workpiece or in the case of the present invention the outwardly extending top portion of the S-shaped fold whereby forming a continuous residual strip that extends from the workpiece.

Figure 3:
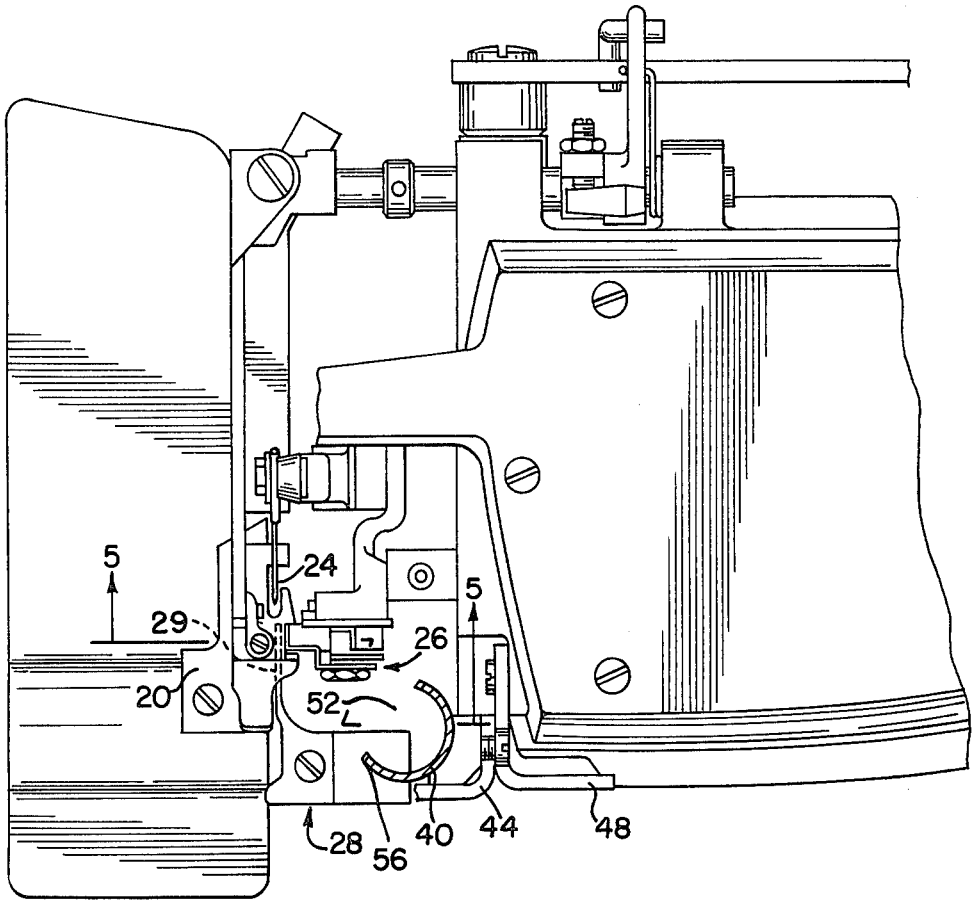
FIG. 3 is a partial top view of the machine incorporating the present invention and showing the suction tube in section.

In accordance with this invention, there is mounted above the top side of the work support means 14 in front of the edge trimming mechanism means 26 a tubular member means 40, which, as shown in FIG. 3, may suitably be circular in cross section. The tubular member means 40 is mounted so that the longitudinal axis of same extends upwardly in a direction generally perpendicular to the work support means 14. The tubular member means 40 is supported in this position by a first bracket means 44 attached by any suitable means, such as 46, to a second bracket means 48 which in turn is mounted to the frame means 12 of the machine 10.

Figure 2:
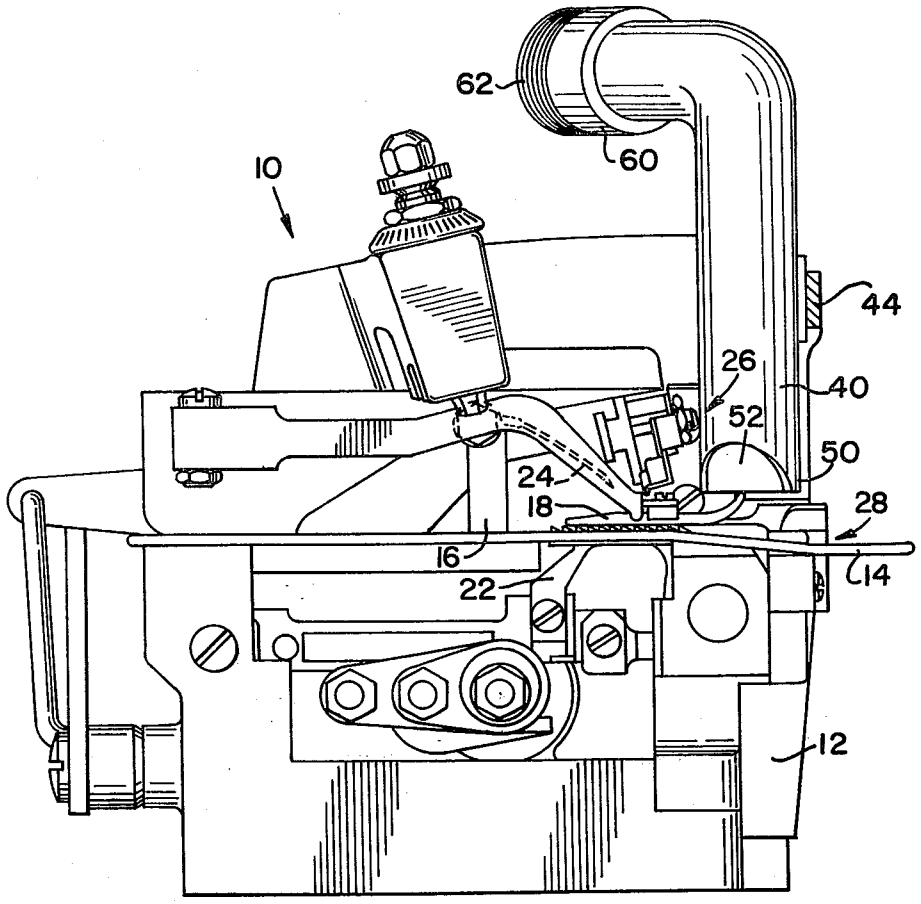
FIG. 2 is a side elevational view of FIG. 1.

As illustrated in FIGS. 1 and 2 the tubular member means 40 is substantially L-shaped. The first end means 50 of the tubular means 40 is provided with an aperture or inlet opening means 52. The aperture 52, best seen in FIG. 3, is angularly disposed in the direction of the trimming mechanism 26. The opening means 52 is provided to allow the continuous residual strip severed from the workpiece to be readily drawn by suction created within the tube means 40 as the workpiece is continually advanced through the stitch forming area of the machine 10. In this manner the residual strip is removed from both the stitching area and the trimming area so as to allow efficient operation of the machine without the residual strip interfering therewith. As may be best seen in FIG. 5, the continuous residual strip 72 is introduced into the interior of the suction tube means 40 by virtue of the action of the suction thereon. To further reduce frictional contact with the residual strip 72 the slot or inlet opening means 52 extends from the first end means 50 to a point a suitable distance therefrom along the longitudinal surface 56 of the tubular member means 40. This slot has a vertical dimension sufficient to enable the free passage of the continuous residual strip therethrough. Connected to the second end means 60 of the tubular member means 40 is an elongated flexible suction tube means 62 which is connected to a source of reduced pressure (not shown) for creating a suction within the tubular member means 40.

Figure 4:
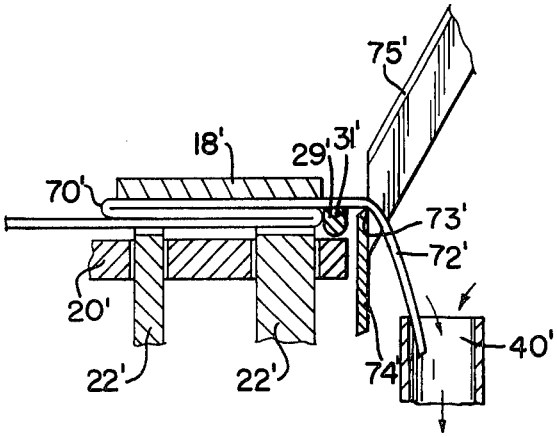
FIG. 4 PRIOR ART
FIG. 4 is a partial cross sectional view of the prior art showing an overedge sewing machine using a suction tube as disposed below the underside of the work support means.
Figure 5:
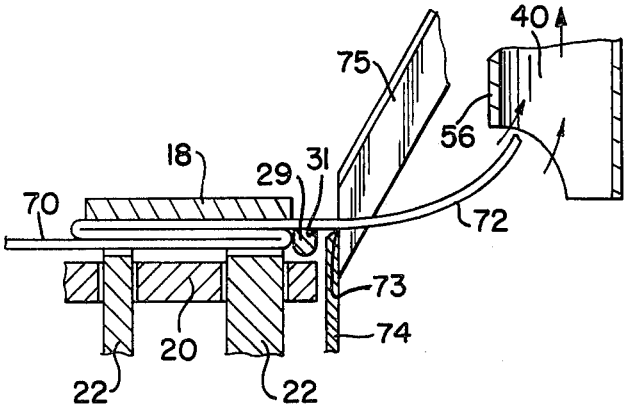
FIG. 5 is a partial cross sectional view as taken along line 5—5 of FIG. 3.

From the above, and by comparing the preferred embodiment shown in FIGS. 3 and 5 versus the suction tube apparatus 40' known in the art and schematically represented in FIG. 4, the advantages of the present invention will be apparent. As was mentioned above, and as shown in FIG. 4, when a known in the art suction tube means 40' is disposed below the underside of the throat plate or workpiece support means 20' certain drawbacks occur. That is, the downward drawing force draws the workpiece 70' and more particularly the continuous residual strip 72' connected thereto downward against the rearwardly extending finger means 29' over the edge 31' thereof whereby creating frictional forces. In addition, the downward drawing force of the suction tube means 40' causes the residual strip 72' to be drawn over a corner portion 73' of the lower knife means 74' whereby causing further frictional forces not only to be imparted to the residual strip 72' but also to the workpiece 70' to which part of the residual strip is still connected. These frictional forces created by the downward suction on the continuous residual strip 72' may effect the guidance of the workpiece 70' and in turn effect the forces inherent in the area surrounding the guide mechanism means 28. Even though the feed dogs 22' are trying to pull the fabric workpiece in a straight line direction, the combination of friction forces caused by the downward drawing suction against the residual strip exert enough pressure to cause the workpiece to be moved about these frictional areas which in turn work as pivot points. That is, the frictional forces may act similar to a pressure point guidance system. In view of the placement of the frictional forces relative the needle means of the machine, the workpiece 70' is moved in a direction away from the guidance mechanism means 28 whereby enhancing the chances of producing an unacceptable garment.

However, and as is apparent from viewing FIG. 5, the present invention creates an upwardly directed drawing force above the top side of the work support means 14. By positioning the tubular member means 40, and more particularly the inlet opening means 52, in a position so as to allow passage of the residual strip means 72 upwardly thereinto from the top side of the work support means 14, many of the frictional forces mentioned above may be reduced. The effect of the upwardly directed drawing force is such that the continuous residual strip 72 severed from the edge of the workpiece is drawn upward away from the sharp edge portion 73 on the lower knife means 74 whereby no frictional forces can be placed on the remainder of the garment workpiece therefrom. In addition, the upward drawing force reduces the frictional contact area between the corner portion 31 of the rearwardly extending finger means 29 by lifting the residual strip 72 away therefrom rather than drawing the same thereover as has been heretofore known in the art. An unexpected result of better edge guiding results from the placement of the suction apparatus above the top side of the work surface. This is a result of the lessening of frictional forces in the area surrounding the work guide mechanism means 28. Accordingly the action of the feed dog means 22 against the workpiece 70 will better perform in the normal manner, that is, to pull the workpiece in a straight line rather than having the latter effected by other frictional forces. As was mentioned above, when using a suction device in combination with a machine of the type described, the diameter of the tubular member is limited to the area below the work support means 14. Therefore, in some instances, an increase in the amount of pulling force may be necessary for certain work pieces to be effectively drawn thereinto whereby increasing the frictional forces. However, by positioning the tubular member means on the top side of the work surface means the constraints mentioned above are lessened and therefore a greater diameter suction tube may be provided.

Thus it is apparent that there has been provided, in accordance with the invention, a suction device for sewing machines that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. In combination with a sewing machine having a stitch forming instrumentality, a feed mechanism for advancing a workpiece to said stitch forming instrumentality, a work guide means arranged in front of said stitch forming instrumentality for guiding said workpiece along a predetermined line, a work support means, a trimming mechanism means adapted to trim an edge portion of said workpiece as it is fed through said machine and an apparatus for removing said trimmed edge, said apparatus comprising:

a tubular member having an inlet end positioned above said work support means at a generally perpendicular angle thereto proximate said work guide means; and means for producing a suction at the outlet end of said tubular member means whereby the trimmed edge is drawn upwardly and a force is exerted on said workpiece in the area of the edge guide in such a manner so as to aid said guide in presenting said workpiece to the stitch forming instrumentality.

2. A sewing machine having a work support means, stitch forming instrumentality means, a workpiece guide mechanism means adapted to urge said workpiece along a path of travel, a feed mechanism means, an edge trimming mechanism means comprising in combination:

a first blade means;

a second blade means moveable into a cutting relationship with said first blade means;

a tubular member means connected to a source of reduced pressure and having an inlet opening means at one end thereof; means for supporting said inlet opening in a position proximate said guide means above said support means at a perpendicular angle thereto and forwardly of said first and second blade means for drawing a continuous strip of material severed by the first and second blade means above said work support means and into said inlet opening means thereby removing the severed portion of the workpiece from the area of the stitch forming instrumentality and exerting a force on said workpiece so as to concomitantly aid in guiding the workpiece to the stitch forming instrumentality.

3. The sewing machine of claim 2 wherein said inlet opening means is angularly positioned in the direction of said first and second blade.

4. The sewing machine of claim 2 wherein said inlet opening means is provided with an inclined surface means, said inclined surface means extending longitudinally of said tubular member means.

* * * * *